US005848880A

United States Patent [19]

Helmig

[11] Patent Number: 5,848,880

[45] **Date of Patent: *Dec. 15, 1998**

[54] AXIAL VALVE ARRANGEMENT FOR A HIGH PRESSURE PLUNGER PUMP

[75] Inventor: Burkhard Helmig, Beckum, Germany

[73] Assignee: Paul Hammelmann Maschinenfabrik GmbH, Oelde, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 790,390

[22] Filed: Jan. 29, 1997

[30] Foreign Application Priority Data

Feb. 6, 1996 [DE] Germany ..... 196 04 132.5

[51] Int. Cl.[6] ..... F04B 39/10

[52] U.S. Cl. ..... 417/560; 92/165 R; 92/168; 417/569

[58] Field of Search ..... 417/560, 569, 417/570; 92/165 R, 168

[56] References Cited

U.S. PATENT DOCUMENTS

| | | | |
|---|---|---|---|
| 2,656,820 | 10/1953 | Becker | 92/168 |
| 3,811,801 | 5/1974 | Buse et al. | 417/454 |
| 3,891,356 | 6/1975 | Christ | 92/168 |
| 5,050,895 | 9/1991 | Hashish et al. | 92/168 |
| 5,064,354 | 11/1991 | Robertson et al. | 417/567 |
| 5,273,405 | 12/1993 | Chalmers et al. | 417/397 |
| 5,362,216 | 11/1994 | Hammelmann | 417/567 |
| 5,493,954 | 2/1996 | Kostohris et al. | 92/168 |

*Primary Examiner*—Timothy Thorpe
*Assistant Examiner*—Cheryl J. Tyler
*Attorney, Agent, or Firm*—Henry M. Feiereisen

[57] ABSTRACT

A high-pressure plunger pump assembly, in particular for working pressures above 2000 bar, includes a housing, a cylinder received in the housing and defining a working space which has an expanded area along a section thereof for receiving a sleeve therein, and a plunger slidably moveable in the working space of the cylinder and in the sleeve and being suitably operated by a drive for reciprocating movement. The sleeve has one end closer to the plunger drive and formed with an annular flange. A suction valve communicates with the cylinder for admitting fluid from a suction chamber into the working space, and a pressure valve communicates with the cylinder for expelling fluid from the working space during a pressure stroke of the plunger, with a seal being positioned in a transitional area from the annular flange to the cylinder between the working space and the suction chamber.

9 Claims, 1 Drawing Sheet

FIG.
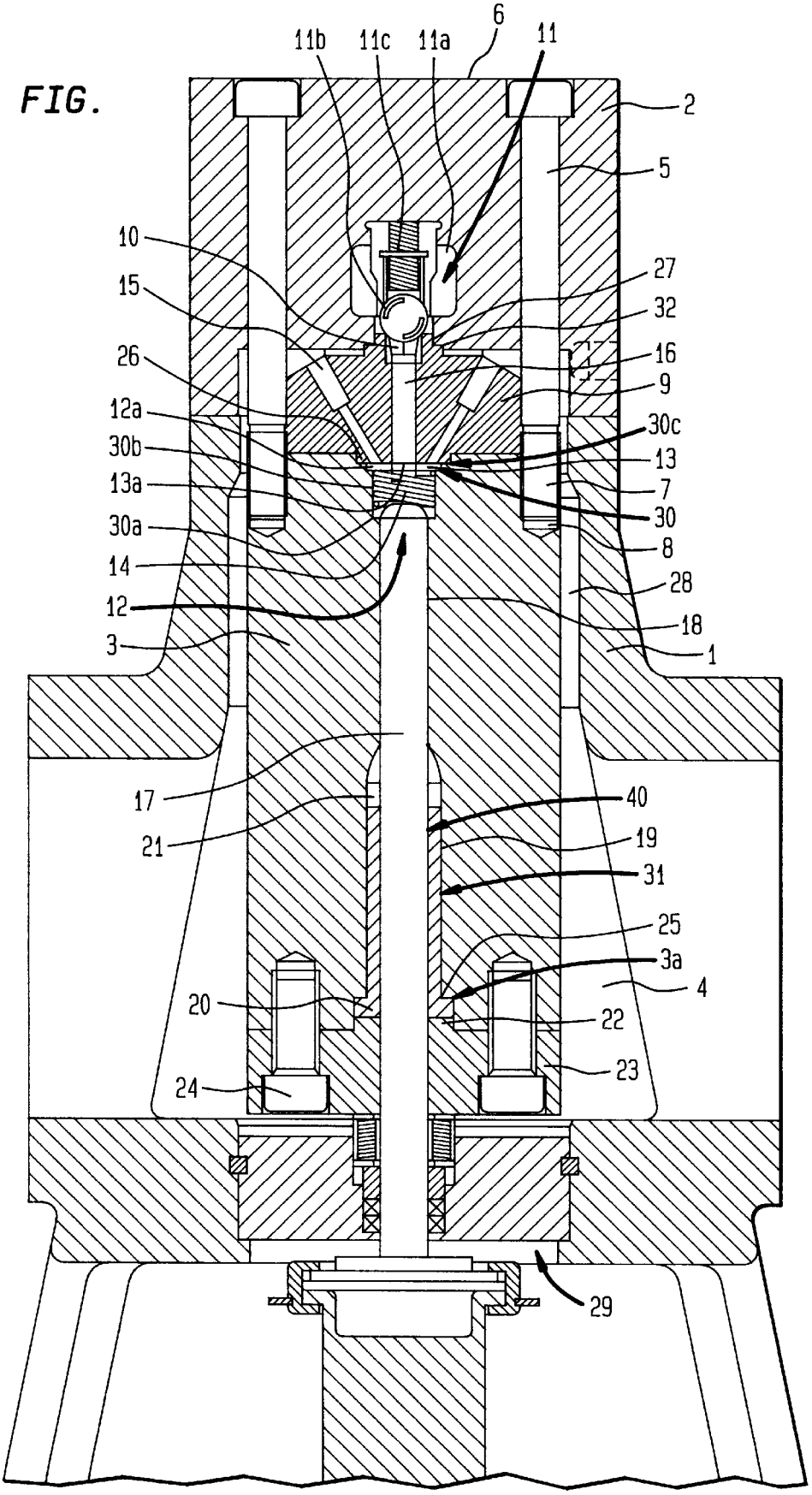

AXIAL VALVE ARRANGEMENT FOR A HIGH PRESSURE PLUNGER PUMP

BACKGROUND OF THE INVENTION

The present invention refers to a high-pressure plunger pump assembly, and in particular to a plunger pump for operation at a working pressure above 2000 bar.

European Pat. No. EP 0 551 590 describes a high-pressure plunger pump of a type including a housing including two axially spaced ends and a pump head secured to one end. Secured in the housing is a cylinder for defining a working space for a plunger which reciprocates within the working space and cooperates with a pressure valve and a suction valve arranged coaxial to the plunger. The cylinder is surrounded by a suction chamber containing fluid to be drawn in and is designed as a sleeve which is floatingly supported on the plunger. The sleeve has two end portions, with one end portion that faces the suction valve converging toward the suction valve so that the sleeve is pressed upon an insert by the fluid during a pressure stroke of the plunger. The insert is of two-part construction, with the area facing the plunger forming the seat for the suction valve while the area facing the pump head forms the seat for the pressure valve.

SUMMARY OF THE INVENTION

It is an object of the present invention to provide an improved high-pressure plunger pump assembly, which is composed of only few, easy to make components while yet ensuring a fluid-tight seal between the working space and the suction side of the pump.

These objects and others which will become apparent hereinafter are attained in accordance with the present invention by a housing which accommodates therein a cylinder provided with a working space in the form of a longitudinal bore which exhibits an expanded area along a section thereof for receiving a sleeve therein, and a plunger which is slidably moveable in the working space of the cylinder and in the sleeve for cooperation with a suction valve communicating with the cylinder for admitting fluid from a suction chamber into the working space, and a pressure valve communicating with the cylinder for discharging fluid from the working space during a pressure stroke of the plunger, with the sleeve having one end formed with an annular flange in proximity to the plunger drive, and with a seal positioned in a transitional area of the annular flange to the cylinder between the working space and the suction chamber.

In accordance with the present invention, a deformation or expansion of the sleeve is eliminated by the elasticity at operational pressure because the working pressure acts from both sides of the sleeve toward the seal near the annular flange. As the sealing gap affects the leakage rate to the third power, the leakage rate is significantly reduced by the pump assembly according to the present invention.

The plunger according to the present invention is typically made of hard metal or ceramics and exhibits hardly any wear during operation of the plunger pump assembly. Only periodically, will it be necessary to replace the sleeve.

According to another feature of the present invention, a pump head is connected to the cylinder, with a valve seat ring being positioned between the pump head and one end of the cylinder for formation of a valve seat for the pressure valve and a valve seat for the suction valve. Suitably, the suction valve has a valve body exhibiting a central overflow bore and is biased by a spring positioned in a cylindrical recess formed in the cylinder adjacent the valve seat ring, with the recess being of stepped configuration. The stepped recess is suitably so configured as to provide a first shoulder for supporting the spring, a second shoulder for supporting the suction valve and a third shoulder for supporting a protrusion of the valve seat ring to thereby effect a form-fitting connection of the valve seat ring with the cylinder.

The connection between the pump head and the cylinder is preferably effected by bolts which extend from an outer boundary surface of the pump head and have shanks threadably engageable in threaded bores within the cylinder.

A high-pressure plunger pump according to the present invention for use at highest pressures can be used in hydrodynamically running cleaning devices and has the advantage that the effective space can be kept particularly small so that the compressibility of the fluid is prevented from decreasing the overall efficiency of the plunger pump assembly.

BRIEF DESCRIPTION OF THE DRAWING

The above and other objects, features and advantages of the present invention will now be described in more detail with reference to the accompanying drawing in which the sole Figure shows a longitudinal section of a high-pressure plunger pump assembly according to the present invention.

DETAILED DESCRIPTION OF A PREFERRED EMBODIMENT

The sole Figure shows a longitudinal section of a high-pressure plunger pump assembly in accordance with the present invention, including a housing 1 centered on an axis 16 and having two axially spaced housing ends. A pump head 2 is secured to one housing end by bolts 5 which extend from an outer surface 6 of the pump head 2 across the entire height thereof and have a shank 7 threadably engaged in complementary bores 8 of a cylinder 3 received within the housing 1. The housing 1 defines a suction chamber 4 which forms the suction side of the plunger pump and surrounds the cylinder 3, with the cylinder 3 being so positioned within the housing 1 that a passageway 28 is formed therebetween and communicates with the suction chamber 4.

A valve seat ring 9 is fitted between the pump head 2 and the cylinder 3 and has formed therein at its pump head proximate end a sleeve-like insert 10 that provides a seat for a pressure valve 11 which is positioned within a pressure chamber 11*a* formed in the pump head 2 on the pressure side of the pump. The pressure valve 11 is of the ball valve type and includes a ball 11*b* which is so biased by a spring 11*c* as to tend to hold the pressure valve 11 in place on the insert 10 to close the valve seat.

On the pressure valve distal side of the valve seat ring 9, the cylinder 3 is formed with a stepped bore 30 for supporting in a form-fitting manner a suction valve 12 which is constructed as a plate valve and positioned coaxially to the pressure valve 11 within the housing 1. The suction valve 12 has a ring-shaped valve body 12*a* formed with a central overflow bore 13*a* and so biased by a spring 14 as to seek the closed position in which the valve body 12*a* of the suction valve 12 rests on a valve seat 13 formed by the valve seat ring 9. The stepped bore 30 exhibits a first shoulder 30*a* for retaining the spring 14, a second shoulder 30*b* for supporting the suction valve body 12*a* and a third shoulder 30*c* for retaining a protrusion 26 of the valve seat ring 9. Through the provision of the protrusion 26, the connection between the valve seat ring 9 and the cylinder 3 is effected in a form-fitting manner. A form-fitting connection between the valve seat ring 9 and the pump head 2 is effected by providing the valve seat ring 9 with a stepped prolongation 27 which engages a complementary stepped recess 32 in the pump head 2.

The valve seat ring 9 is formed with suction channels 15 which are in communication with the passageway 28 and extend across the valve seat ring 9 up to the seat 13 at an acute angle to the center axis 16.

The cylinder 3 has formed therein a longitudinal bore 18 which forms a working space and has an expanded area 21 along a major portion thereof for receiving a sleeve 19. Sildeably received in the longitudinal bore 18 and the sleeve 19 is a plunger 17 which is driven for reciprocating movement typically through a crankshaft (not shown) from an external source. The plunger 17 is retained at its end distant to the suction valve 12 in a stuffing box, generally designated by reference numeral 29 and received in the housing 1.

The sleeve 19 has two axially spaced end portions, with one end portion that is closer to the suction valve 12 converging toward the plunger 17 and with the other end portion that is distant to the suction valve 12 formed with an annular flange 20 which is received in a complementary recess 3*a* of the cylinder 3. Projecting into the recess 3*a* is also a protusion 22 of a cover 23 which is positioned between the stuffing box 29 and the cylinder 3 and connected to the cylinder 3 by bolts 24, with the protrusion 22 bearing upon the annular flange 20. Disposed in a transitional area between the annular flange 20 and the sleeve 19 is a seal 25 by which the working space of the plunger pump is sealed from the suction chamber 4.

At operation, when the plunger 17 is driven to execute a suction stroke and thus is moved in downward direction, the suction valve 12 clears the seat 13 in opposition to the force of the spring 14 to allow fluid to be drawn from the suction chamber 4 and passageway 28 into the channels 15 and eventually into the working space formed by the longitudinal bore 18. After reaching the dead center at the end of the suction stroke, the suction valve 12 closes and the reciprocating (upward) movement of the plunger 17 pushes the fluid through the overflow bore 13*a* and past the opened pressure valve 11 as ball 11*b* clears the seat formed by the insert 10 so that fluid can now enter the pressure chamber 11*a* for ultimate discharge to a fluid-operated system (not shown).

During pressure stroke of the plunger 17, pressure builds up in the annular gap 40 formed between the plunger 17 and the sleeve 19 and in the annular gap 31 formed between the sleeve 19 and the cylinder 3. Thus, the sleeve 19 is subjected to pressure from opposing sides so that an elastic deformation of the sleeve 19 is substantially eliminated. In this manner, the seal 25 executes a superior sealing action for sealing the working space of the pump from the suction chamber.

While the invention has been illustrated and described as embodied in a high-pressure plunger pump assembly, it is not intended to be limited to the details shown since various modifications and structural changes may be made without departing in any way from the spirit of the present invention.

What is claimed as new and desired to be protected by letters patent is set forth in the appended claims:

1. A high-pressure plunger pump assembly, comprising:

a housing having an inlet port;

a cylinder received in the housing and formed with a longitudinal bore defining a working space and having an expanded area along a section thereof;

a sleeve received in the expanded area and positioned in alignment with the inlet port;

a plunger slidably moveable in the longitudinal bore of the cylinder and in the sleeve;

driving means operatively connected to the plunger for controlling movement of the plunger;

a suction valve communicating with the cylinder for admitting fluid from the inlet port into the working space during a suction stroke of the plunger;

a pressure valve communicating with the cylinder for expelling fluid from the working space during a pressure stroke of the plunger; and a seal for sealing the working space from the suction chamber;

said sleeve includes a main body having axially spaced ends, with one of the ends positioned closer to the driving means being formed with an annular flange, said seal being positioned between the cylinder and a junction area between the annular flange and the main body of the sleeve and being subject to a pressure applied by fluid in the inlet port and acting upon the sleeve during pressure stroke of the plunger, resulting in a minimization of a sealing gap between the sleeve and the plunger.

2. The pump assembly of claim 1 wherein the cylinder has formed therein a recess having a contour complementing a contour of the annular flange of the sleeve, and further comprising a cover threadably engaged to the cylinder and being formed with a protrusion received in the recess and bearing upon the annular flange.

3. The pump assembly of claim 1 and further comprising a pump head connected to the cylinder, and a valve seat ring positioned between the pump head and one end of the cylinder and exhibiting a valve seat for the pressure valve and a valve seat for the suction valve, said suction valve having a valve body formed with a central overflow bore and being biased by a spring positioned in a cylindrical recess formed in the cylinder adjacent the valve seat ring.

4. The pump assembly of claim 3 wherein the recess is of stepped configuration.

5. The pump assembly of claim 4 wherein the stepped recess is so designed as to provide a first shoulder for supporting the spring, a second shoulder for supporting the suction valve and a third shoulder for supporting a protusion of the valve seat ring to thereby effect a form-fitting connection of the valve seat ring with the cylinder.

6. The pump assembly of claim 3 wherein the pump head is threadably engaged to the cylinder.

7. The pump assembly of claim 6 wherein the pump head is connected in form-fitting manner with the valve seat ring, and the valve seat ring is connected in form-fitting manner with the cylinder.

8. The pump assembly of claim 1, and further comprising a sleeve-like insert fitted in the valve seat ring for forming a valve seat for the pressure valve.

9. The pump assembly of claim 8 wherein the sleeve-like insert has a flow cross-section expanding in direction toward the pressure valve.

* * * * *